US006538536B1

(12) United States Patent
Seely et al.

(10) Patent No.: US 6,538,536 B1
(45) Date of Patent: Mar. 25, 2003

(54) DIELECTRIC RESONATOR OSCILLATOR AND METHODS OF ASSEMBLY THEREFOR

(75) Inventors: Warren L. Seely, Chandler, AZ (US); Charles J. Goodman, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 48 days.

(21) Appl. No.: 09/672,230

(22) Filed: Sep. 27, 2000

(51) Int. Cl.[7] ..... H01P 7/10
(52) U.S. Cl. ..... 333/235; 333/219.1; 331/107 DP
(58) Field of Search ..... 333/219.1, 235; 331/96, 99, 107 DP, 117 D

(56) References Cited

U.S. PATENT DOCUMENTS 5,027,090 A * 6/1991 Gueble et al. ..... 333/219.1 X
5,233,319 A 8/1993 Mizan et al. ..... 333/235
5,323,129 A * 6/1994 Harris ..... 333/219.1
5,608,363 A * 3/1997 Cameron et al. .... 333/219.1 X
5,612,655 A * 3/1997 Stronks et al. ..... 333/219.1 X
5,714,920 A * 2/1998 Ivanov et al. ..... 333/219.1
6,002,311 A * 12/1999 Wey et al. ..... 333/219.1

* cited by examiner

*Primary Examiner*—Robert Pascal
*Assistant Examiner*—Stephen E. Jones
(74) *Attorney, Agent, or Firm*—Ingrassia Fisher & Lorenz

(57) ABSTRACT

A dielectric resonator oscillator (DRO) (200, FIG. 2; 600, FIG. 6; 900, FIG. 9) includes a dielectric resonator (202, 602, 902) that is held in a fixed position with respect to the housing lid (206, 606, 906). In one embodiment, the resonator is attached to the housing lid using one or more support legs (208). In another embodiment, the resonator is attached to the housing lid using a ring structure (608). In still another embodiment, the resonator is attached to the lid and housing (904) using a lid tuner (914) and lid pedestal (908), and a housing tuner (915) and housing pedestal (909). Resonator positioning within the DRO cavity (222, 622, 922) is simplified by accurately aligning and attaching the support structure to the resonator.

13 Claims, 5 Drawing Sheets

-PRIOR ART-

DIELECTRIC RESONATOR OSCILLATOR AND METHODS OF ASSEMBLY THEREFOR

TECHNICAL FIELD

The invention relates generally to dielectric resonator oscillators (DROs) and methods of their assembly and, more specifically, to DROs having dielectric resonators that are attached to the DRO housing in such a manner that the DRO operation is not substantially affected by mechanical vibration.

BACKGROUND OF THE INVENTION

Dielectric resonator oscillators (DROs) are commonly used in high-precision RF and microwave systems to generate high-frequency signals of extremely good spectral purity. For example, DROs have been used in radars, transponders, and communication systems, among other systems, to generate microwave signals with extremely low phase noise and good temperature stability. Generally, in these systems, the DRO is used to generate a frequency that is locked to a reference oscillator within a phase-locked loop circuit.

FIG. 1 illustrates a cross-sectional, side view of a DRO 100 in accordance with the prior art. DRO 100 includes dielectric resonator 102, housing 104, housing lid 106, dielectric pedestal 108, printed wiring board substrate 110, microstrips 112, tuning screw 114, and wall mounted electric tuner 116. Dielectric resonator 102 is used as a frequency determining circuit element. Dielectric resonator 102 is made of a rigid ceramic material, having a very high dielectric value.

Housing 104 and housing lid 106 are made of a metallic material. Housing 104 is a structure having a bottom 118 and sides 120. When assembled, housing 104 and housing lid 106 create a resonant cavity 122.

During operation, electromagnetic energy is coupled into cavity 122 and resonator 102 at the resonant frequency via microstrips 112 located on substrate 110, which is located on the housing bottom 114. Likewise, energy at the resonant frequency can be extracted from cavity 122 via microstrips 112.

The relative position of dielectric resonator 102 within resonant cavity 122 affects the frequency characteristics and the Q of the DRO. The position of resonator 102 is defined by the height of pedestal 108 and the horizontal placement of dielectric resonator 102 on pedestal 108. Pedestal 108 is made of a solid, low-loss, low-dielectric constant material.

During a typical assembly process, substrate 110 and microstrips 112 are first attached to the housing bottom 118. Then, pedestal 108 is attached to the substrate 110 using an epoxy material, which requires a high-temperature, heat-curing process. In some prior art processes, pedestal 108 is attached directly to housing bottom 118 using an epoxy, after substrate 110 is attached to the housing bottom 118.

After pedestal 108 is attached to housing 104 (or substrate 110) and heat-cured, resonator 102 is placed on pedestal 108, and an iterative position adjustment process is performed. This is necessary because the oscillator circuit will oscillate only over a fairly narrow range of resonator positions on pedestal 108. The position adjustment process involves assembling housing lid 106 to housing 104, and testing the frequency. The lid 106 is then removed, and if the frequency is not accurate enough, the resonator position on pedestal 108 is adjusted along the horizontal plane. This testing and position adjustment process is repeated until the desired performance is attained. Resonator 102 is then carefully removed, applied with epoxy, and re-positioned on pedestal 108. The assembly is again heat-cured and tested for performance. Coarse frequency adjustments are then performed using tuning screw 114, as is described below.

As the above description indicates, the entire DRO 100 is heated at least twice during assembly. This double-heating process decreases the yield of acceptable DROs, because the circuitry within DRO 100 is cumulatively affected by the heating processes. In addition, it can be difficult and time consuming to accurately adjust the position of resonator 102 on pedestal 108, and to accurately re-position resonator 102 on pedestal 108 after application of the epoxy to resonator 102.

The dimensions of resonator 102 define the resonant frequency of resonator 102. This frequency can be varied by a small percentage using tuning screw 114 and/or electric tuner 116, both of which capacitively load resonator 102. Tuning screw 114 is used to coarsely tune resonator 102 (e.g., within about one percent of the resonant frequency), and wall mounted electric tuner 116 is used to finely tune resonator 102 (e.g., by tenths of a percent).

The frequency characteristics of resonator 102 are adversely affected if tuning screw 114 makes contact with resonator 102. Accordingly, an air gap 128 must exist between the bottom of tuning screw 114 and the top of resonator 102 in prior art systems.

In this prior art configuration, resonator 102 is held in position only by pedestal 108. Accordingly, when DRO 100 is subject to mechanical vibration, pedestal 108 and resonator 102 can sway. When the vibration is sufficient, the movement of resonator 102 within cavity 122 can be enough to adversely affect the frequency characteristics of the DRO 100. In some cases, the movement can be severe enough to cause frequency fluctuations in the megahertz range, which can cause a DRO that is used in conjunction with a phase-locked loop circuit to lose lock with the reference oscillator. If the vibration is more than momentary, the circuit will continue to lose lock. Because prior art DROs are so sensitive to resonator position, prior art DROs are unsuitable, in many cases, for use in mobile apparatus, or other apparatus that may experience vibration conditions.

What are needed are DROs and methods of their assembly that simplify the process of positioning the dielectric resonator within the DRO cavity. In addition, what are needed are methods of assembling a DRO that eliminate the need to subject the DRO circuitry to multiple heating processes. Finally, what are needed are DROs that have resonators mounted in a manner that the DRO operation is not substantially affected by mechanical vibration.

DETAILED DESCRIPTION

Embodiments of the present invention provide a dielectric resonator oscillator (DRO) having a dielectric resonator that is held in a fixed position with respect to the DRO housing lid using a support structure that extends downward from the housing lid. This firm attachment results in a DRO whose operation is not substantially affected by mechanical vibration.

In one embodiment, the resonator is attached to the housing lid using one or more support legs that contact portions of the top and side of the resonator. In another embodiment, the resonator is attached to the housing lid using a ring structure that contacts the top of the resonator. In still another embodiment, the resonator is attached to the housing and housing lid using two support structures that contact the top and bottom of the resonator, each structure including a tuning screw and a dielectric pedestal. During assembly of each of these embodiments, the accurate alignment of the resonator within the DRO cavity is much simpler than with prior art DROs. In addition, the DRO circuitry is not subject to multiple heating processes, as is done in prior art DRO assembly methods.

Figure 1:
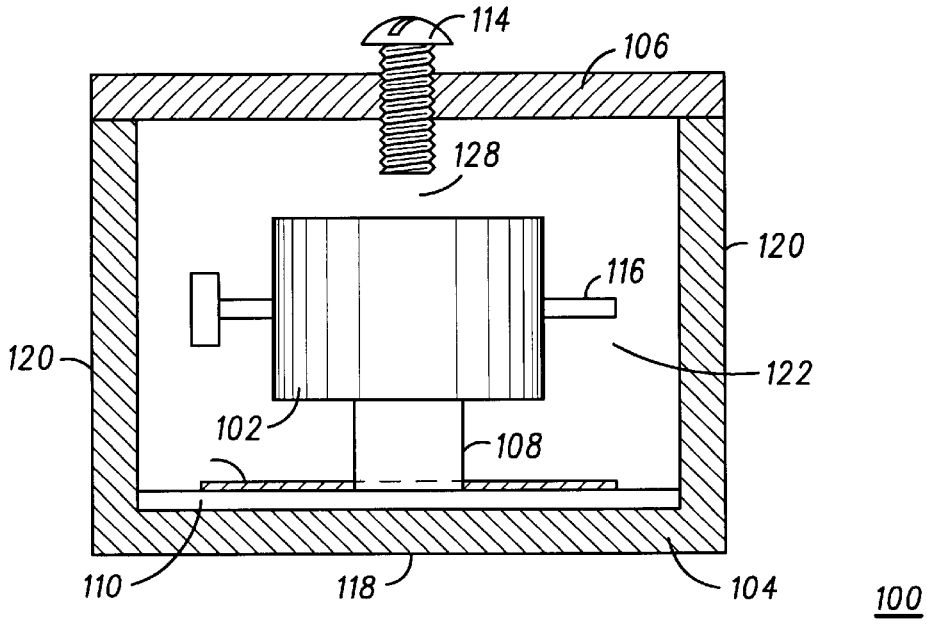
FIG. 1 illustrates a cross-sectional, side view of a dielectric resonator oscillator (DRO) in accordance with the prior art.
Figure 2:
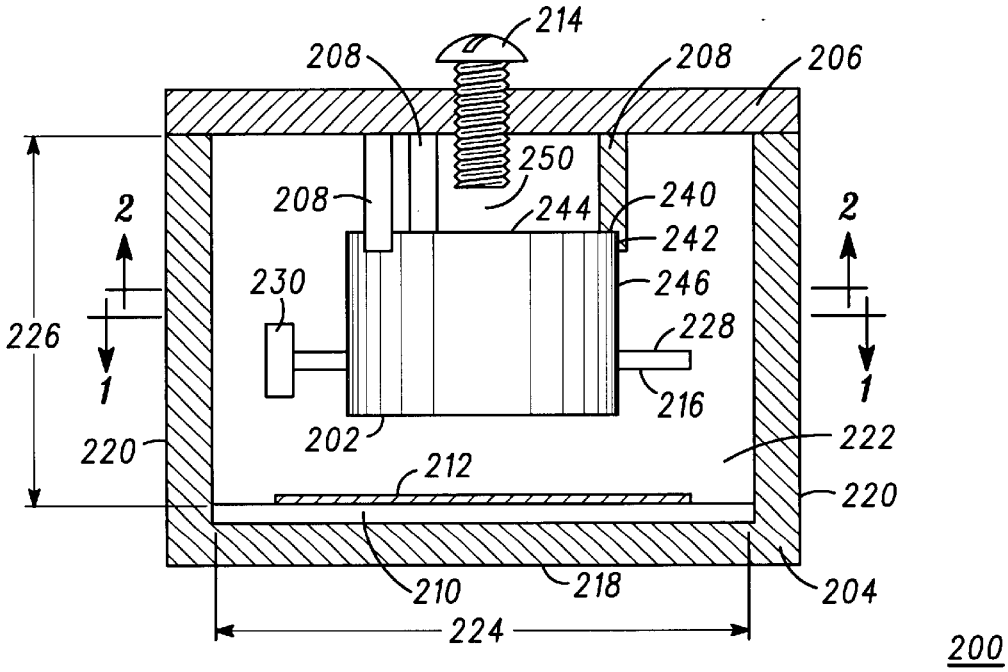
FIG. 2 illustrates a cross-sectional, side view of a DRO in accordance with one embodiment of the present invention.

FIG. 2 illustrates a cross-sectional, side view of a DRO in accordance with one embodiment of the present invention. DRO 200 includes dielectric resonator 202, housing 204, housing lid 206, support legs 208, printed wiring board substrate 210, microstrips 212, tuning screw 214, and electric tuner 216.

Dielectric resonator 202 is used as a frequency determining circuit element. Dielectric resonator 202 is made of a rigid ceramic material, having a very high dielectric value. Resonator 202 is often referred to as a "disk" or "puck" because it typically has a cylindrical shape, although resonators of other shapes are also used. The dimensions of resonator 202 define its resonant frequency. For example, a resonator having dimensions of 0.75 cm in diameter by 0.3 cm in height would have a resonant frequency of about 6 GHz. Typical resonators have resonant frequencies in a range of 2–30 GHz, although resonators with higher or lower resonant frequencies also could be used.

Housing 204 and housing lid 206 comprise a metallic material, such as aluminum, copper, silver or another conductive material, or a mixture thereof. Housing 204 is a structure having a bottom 218 and sides 220. When assembled, housing 204 and housing lid 206 create a resonant cavity 222. Typically, the dimensions of cavity 222 are chosen so that the natural resonant frequency of resonator 202 is unperturbed when placed inside cavity 222. The width 224 of cavity 222 is typically from two to three times the diameter of resonator 202, and the height 226 of cavity 222 is typically up to about two times the thickness of resonator 202, although cavities 222 having different dimensions could be used as well. During operation, electromagnetic energy is coupled into cavity 222 and resonator 202 at the resonant frequency via microstrips 212 located on substrate 210 on the housing bottom 218.

Figure 3:
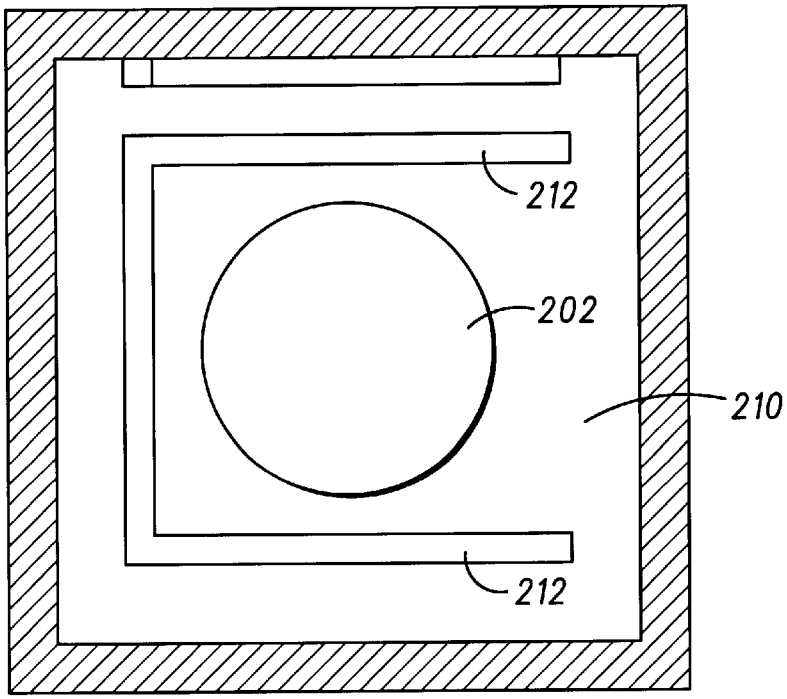
FIG. 3 illustrates a view of the DRO of FIG. 2 taken along line 1—1 of FIG. 2 and looking in the direction of the arrows.

FIG. 3 illustrates a view of the DRO of FIG. 2 taken along line 1—1 of FIG. 2 and looking in the direction of the arrows. Microstrips 212, which are formed (e.g. through deposition) on the printed wiring board substrate 210, are shown to have a "U" shaped configuration, although other configurations could be used as well. When current is passed through microstrips 212, a magnetic field is formed through resonator 202, causing energy to be coupled into resonator 202. Resonator 202 then resonates at a sharp resonance, based on the Q of resonator 202. The Q of resonator 202 is typically from 8,000–12,000, although the Q could be higher or lower than this range as well. Energy at the resonant frequency can be extracted from the resonant cavity (e.g., cavity 222, FIG. 2) via microstrips 212. In general, DRO 200 enables only a very narrow band of frequencies to pass through, making it particularly useful as a very narrow-band filter.

Generally, the farther resonator 202 is away from the printed wiring board substrate 210 and microstrips 212, the higher the Q of the resonant network and the lower the phase noise, resulting in a narrower band of frequencies allowed to pass through the DRO (i.e., a more pure tone). Referring back to FIG. 2, the position of resonator 202 is defined by the location and height of support legs 208. The height of supports 208 is typically chosen to position resonator 202 such that performance near the desired frequency is maintained, although resonator 202 could be positioned closer to or farther from microstrips 212 as well.

Each of support legs 208 includes a step, in one embodiment, where the step has a first surface 240 and a second surface 242. When resonator 202 is seated on support legs 208, the first surface 240 is substantially parallel to and contacts the top surface 244 of resonator 202 and the second surface 242 is substantially parallel to and contacts the side surface 246 of resonator 202. In one embodiment, resonator 202 is seated on and attached to support legs 208 using an adhesive, such as an epoxy, or using some other attachment mechanism (e.g., friction, one or more clips, or a bottom support member).

Figure 4:
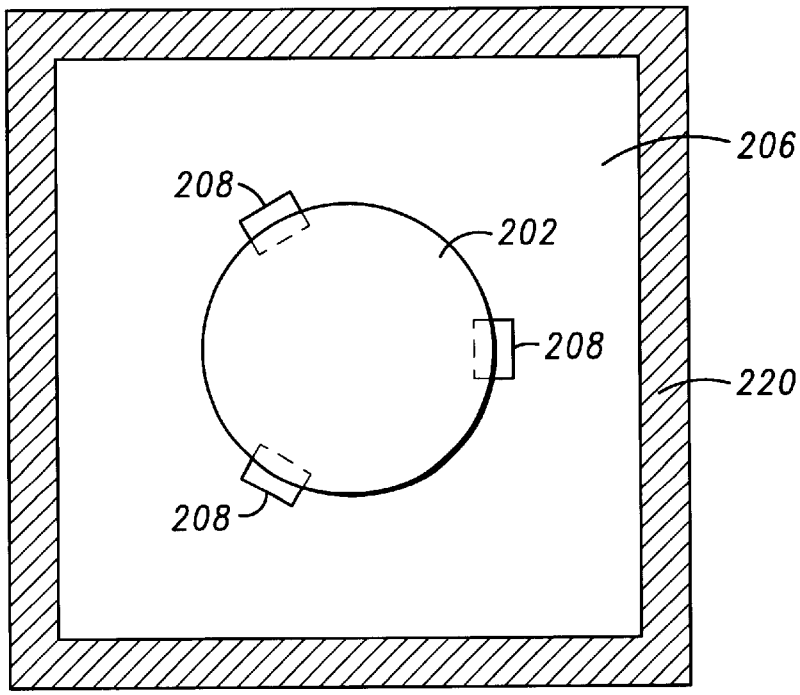
FIG. 4 illustrates a view of the housing lid of the DRO of FIG. 2 taken along line 2—2 of FIG. 2 and looking in the direction of the arrows.

FIG. 4 illustrates a view of the housing lid of the DRO of FIG. 2 taken along line 2—2 of FIG. 2 and looking in the direction of the arrows. In one embodiment, support legs 208 are evenly spaced around the circumference of resonator 202. In other embodiments, legs 208 could be unevenly spaced.

Referring again to FIG. 2, in one embodiment, support legs 208 are integrally attached to housing lid 206. Accordingly, support legs 208 are composed of the same material (e.g., a metallic material) as housing lid 206. Support legs 208 are machined to machine tolerances on the bottom surface of housing lid 206, in one embodiment, so their position and dimensions can be extremely accurate. Accordingly, support legs 208 can be designed so that, when resonator 202 is seated within them, resonator 202 will be aligned exactly where it should be within cavity 222. In this manner, the desired frequency characteristics, phase noise, and Q of the DRO 200 are achieved. This eliminates the need for the iterative position adjustment process that is used in prior art DRO assembly processes. In one embodiment, the resonator height is pre-determined to result in the desired stability characteristics throughout a desired temperature range. As is described later, during a tuning process, the resonant frequency is tested, and the frequency of DRO 200 is adjusted by moving tuning screw 214 into or out of cavity 222 until the desired frequency is obtained.

This results in a solid assembly, in which the resonator 202 will not sway, as with prior art systems. Support legs 208 lock resonator 202 down so that DRO 200 can withstand substantial vibration without experiencing unacceptable frequency changes, and thus maintaining lock.

In another embodiment, support legs 208 are coupled to housing lid 206 using an adhesive, such as an epoxy, or some other connection mechanism (e.g., friction, one or more clips or solder). In such an embodiment, support legs 208 could be composed of the same or a different material as housing lid 206. For example, support legs 208 could be a metallic material, a dielectric material, or some other material.

To aid in the accurate positioning and attachment of support legs 208, a notch (not shown) of a complementary size to house support legs 208 is formed (e.g. by machining) into the bottom surface of housing lid 206, in one embodiment. Each support leg 208 is then seated in the complementary notch when the leg is connected to the housing lid 206. The notches are machined, in one embodiment, so that accurate positioning of resonator 202 within cavity 222 is easily achievable.

In the embodiment shown in FIGS. 2 and 4, three, evenly-spaced support legs 208 are used to provide three points of support to resonator 202. In alternate embodiments, more or fewer support legs 208 could be used, and support legs 208 could be spaced unevenly. For example, in one embodiment, a single support leg could form a whole or partial ring, which includes a step upon which resonator 202 is seated. In other embodiments, two support legs could be used, or four or more support legs could be used. In addition, if resonator 202 has a shape other than a cylindrical shape (e.g., square, rectangle, oval, triangle, hexagon, or other multi-sided or free-form shape), then a number of support legs necessary to provide adequate support should be used.

In an embodiment where support legs 208 are composed of a metallic material, the metallic material contacts resonator 202. Because the field within resonator 202 is concentrated in the center of resonator 202, the metallic material contacting the corners of resonator 202 does not result in a decrease in the electrical performance of resonator 202, as long as the first and second surfaces 240, 242 of the support leg step are sufficiently narrow. In another embodiment, a dielectric material (not shown) that shields resonator 202 from the metallic legs 208 is disposed between the first and/or second surfaces 240, 242 and resonator 202. This enables the first and/or second surfaces 240, 242 to be wider, if desired, than they should be for the unshielded embodiment.

As described previously, the dimensions of resonator 202 defined the resonant frequency of resonator 202. This frequency can be varied by a small percentage using tuning screw 214 and/or electric tuner 216, both of which capacitively load resonator 202.

Tuning screw 214 is used to coarsely tune resonator 202 (e.g., within about one percent of the resonant frequency). Tuning screw 214 is electrically conductive and is engaged with and extends through lid 206 for selective vertical movement into cavity 222 along the vertical axis of resonator 202. When tuning screw 214 is withdrawn, thus increasing air gap 250, the resonant frequency of resonator 202 is substantially a function of the size and composition of resonator 202 and the dimensions of cavity 222. Cavity 222 can be tuned to other frequencies by advancing screw 214 into cavity 222. Moving screw 214 into cavity 222 causes air gap 250 to be decreased, and cavity 222 to be resonant at a higher center frequency.

Electric tuner 216 is used to finely tune resonator 202 (e.g., by tenths of a percent) by capacitively loading resonator 202. In one embodiment, electric tuner 216 is located along a portion of one or more sides 220 of housing 204. Electric tuner 216 includes microstrip 228 coupled in series with varactor diode 230, in one embodiment. Together, microstrip 228 and diode 230 perturb the tuning of cavity 222 when diode 230 is biased with a DC voltage. A conductor (not shown) is coupled to microstrip 228 on one side of diode 230, and extends to the exterior of cavity 222. The DC biasing voltage is applied to diode 230 via the conductor and an end portion of microstrip 228. When biased, diode 230 introduces a series capacitance into microstrip 228. The value of the capacitance, and thus the resonant frequency of DRO 200, is adjusted by adjusting the DC bias voltage on diode 230.

In another embodiment in which DRO 200 is electrically tunable, one side of varactor diode 230 is coupled in parallel with microstrip 228, and the other side of diode 230 is coupled to a grounded conductor (not shown). A DC bias voltage applied to an end portion of microstrip 228 causes microstrip 228 to be capacitively coupled to ground. In this regard, the capacitance is a function of the DC bias voltage on diode 230. As such, the resonant frequency of DRO 200 is electrically tuned by adjusting the DC bias voltage.

Figure 5:
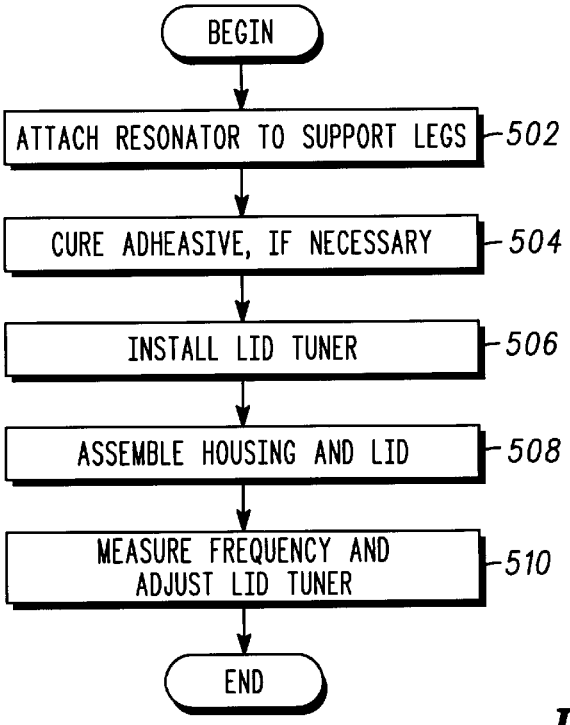
FIG. 5 illustrates a flowchart of a method for assembling the DRO shown in FIG. 2 in accordance with one embodiment of the present invention.

FIG. 5 illustrates a flowchart of a method for assembling the DRO shown in FIG. 2 in accordance with one embodiment of the present invention. The method begins, in block 502, by attaching a resonator (e.g., resonator 202, FIG. 2) to support legs (e.g., legs 208) in accordance with one of the various embodiments of the invention, described above. As mentioned previously, the support legs could be formed with or coupled to the housing lid. In one embodiment, attachment is achieved by applying an adhesive, such as an epoxy, to portions of the resonator and/or to the first and/or second surfaces (e.g., surfaces 240, 242) of the support legs. If necessary, the adhesive is then cured, in block 504, by heating the lid assembly. In other embodiments, the resonator could be attached to the support legs using some other mechanism, such as friction, one or more clips, a bottom support member, an adhesive that requires no curing, or some other suitable technique.

In block 506, a lid tuner (e.g., tuner 214) is installed in a complementary tuner hole in the housing lid. This is done, for example, by screwing the lid tuner into the tuner hole.

In block 508, the housing and lid are then assembled, forming a resonant cavity (e.g., cavity 222) within which the resonator is positioned. The housing includes microstrips (e.g., microstrips 212) and an electronic tuner (e.g., tuner 216), in one embodiment.

The resonant frequency of the DRO is then measured, in block 510, and the lid tuner is adjusted to achieve the desired frequency, if necessary. The method then ends.

One advantage to the method described above is that it is not necessary for the DRO circuitry (e.g., microstrips 212 and electronic tuner 216) to be subjected to the high-temperature, heat curing processes that were necessary in prior art systems. Only the lid assembly is cured, in one embodiment. Thus, the method of the present invention results in a higher yield, because the DRO circuitry is not affected by the heating processes necessary using prior art methods. In addition, because the support legs can be machined to machine tolerances, in one embodiment, they can be designed to seat the dielectric resonator at the exact position within the resonant cavity that will yield the desired frequency. Thus, the iterative position adjustment process that was necessary using prior art systems is not necessary using the present invention.

Figure 6:
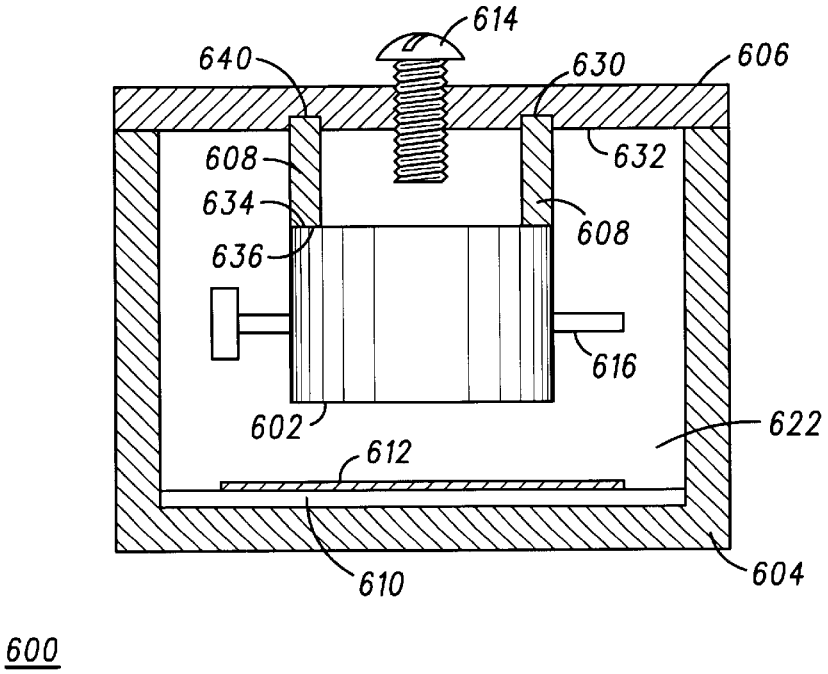
FIG. 6 illustrates a cross-sectional, side view of a DRO in accordance with a second embodiment of the present invention.

FIG. 6 illustrates a cross-sectional, side view of a DRO 600 in accordance with a second embodiment of the present invention. DRO 600 is similar to the DRO 200 described in conjunction with FIG. 2, in that it includes dielectric resonator 602, housing 604, housing lid 606, printed wiring board substrate 610, microstrips 612, tuning screw 614, and electric tuner 616. Each of these components functions much in the same manner as the embodiments described in conjunction with FIG. 2.

The embodiment shown in FIG. 6 differs from the embodiment shown in FIG. 2, however, in that a ring structure 608 is used to hold resonator 602 in a fixed position with respect to housing lid 606. A top surface 630 of ring structure 608 is attached to the bottom surface 632 of housing lid 606, and a bottom surface 634 of ring structure 608 is attached to a top surface 636 of resonator 602.

Ring structure 608 can be designed so that, when resonator 602 is aligned with and coupled to it, resonator 602 will be positioned exactly where it should be, within resonant cavity 622, in a manner that the desired frequency characteristics, phase noise, and Q of the DRO 600 are achieved. This eliminates the need for the iterative position adjustment process that is used in prior art DRO assembly processes. In one embodiment, the resonator height is predetermined to result in the desired stability characteristics throughout a desired temperature range.

In one embodiment, ring structure 608 comprises a solid, low-loss, low-dielectric constant material, such as alumina, sapphire, Eco-foam, lithium niabate or boron nitride, for example. In such an embodiment, the width of the bottom surface 634 of ring structure 608 can be wider than the width of the step in the embodiment shown in FIG. 2, although it is not necessarily so. In another embodiment, ring structure 608 could comprise a metallic material, which is integrally attached to or coupled to housing lid 606. In such an embodiment, a shielding material could be used between ring structure 608 and resonator 602.

FIG. 6 shows a ring structure 608 having a rectangular cross-section. In other embodiments, ring structure 608 could have a round, oval, triangular, hexagonal, or other multi-sided or free-form cross-sectional shape.

Housing lid 606 includes a notch 640 in its bottom surface 632, in one embodiment, into which ring structure 608 is seated, enabling ring structure 608 to be accurately connected during assembly. In another embodiment, no notch is used for alignment, and ring structure 608 is otherwise positioned on housing lid 606.

Figure 7:
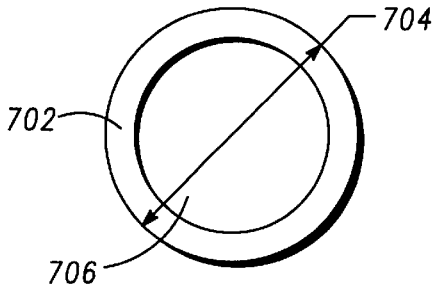
FIG. 7 illustrates a top view of a ring structure in accordance with the embodiment shown in FIG. 6.

FIG. 7 illustrates a top view of a ring structure 702 in accordance with the embodiment shown in FIG. 6. In one embodiment, an outer diameter 704 of ring structure 702 is approximately equal to a diameter of resonator 602. During assembly, this enables ring structure 702 and resonator 602 to be easily and accurately aligned and coupled together. In other embodiments, where resonator 602 is not cylindrical in shape, an outer circumference of ring structure 702 is made to match the circumference of resonator 602, whatever that shape may be. In still other embodiments, the circumference of ring structure 702 may not match the circumference of resonator 602.

An opening 706 exists in the center of ring structure 702. When ring structure 702 is assembled with housing lid 606 and resonator 602, the opening 706 provides an air gap and a space into which tuner 614 may advance to adjust the resonant frequency. Although the embodiment shown in FIG. 7 illustrates circular inner and outer circumferences, the inner or outer circumferences could have other shapes as well.

The attachment of resonator 602 to ring structure 608 and housing lid 606 results in a solid assembly, in which the resonator 602 will not sway, as with prior art systems. Thus, DRO 600 can withstand substantial vibration without experiencing unacceptable frequency changes, and thus maintaining lock.

Figure 8:
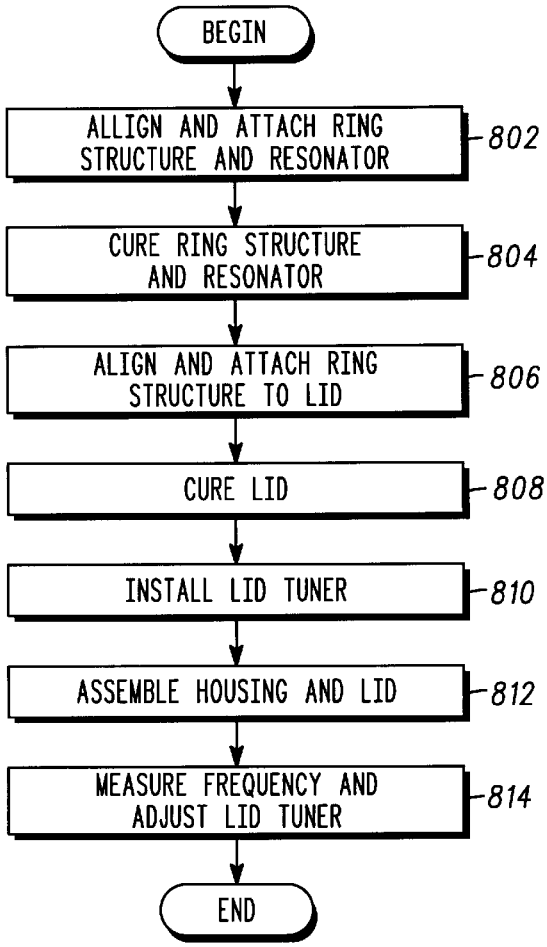
FIG. 8 illustrates a flowchart of a method for assembling the DRO shown in FIG. 6 in accordance with one embodiment of the present invention.

FIG. 8 illustrates a flowchart of a method for assembling the DRO shown in FIG. 6 in accordance with one embodiment of the present invention. The method begins, in block 802, by aligning and attaching together a ring structure (e.g., ring structure 608) and a resonator (e.g., resonator 602). In one embodiment, this is done by applying an adhesive, such as an epoxy, to portions of the resonator and/or to the bottom surface of the ring structure, accurately aligning the resonator and ring structure, and pressing them together. In one embodiment, the components are accurately aligned using a sleeve or other alignment mechanism, which is designed to align components of the size and shape of the ring structure and resonator.

If necessary, the adhesive is then cured, in block 804, by heating the resonator and ring structure. In other embodiments, the resonator could be attached to the ring structure using some other mechanism, such as an adhesive that requires no curing or some other suitable technique.

In block 806, the ring structure is then aligned and attached to the housing lid (e.g., lid 606). In one embodiment, this is done by applying an adhesive, such as an epoxy, to the top surface of the ring structure and/or within a notch (e.g., notch 640) on the bottom surface of the housing lid. The ring structure is then pressed into the notch. The adhesive is cured, if necessary, in block 808, by heating the housing lid, ring structure, and resonator. In other embodiments, the ring structure could be attached to the housing lid using some other mechanism, such as friction, one or more clips, a bottom support, an adhesive that requires no curing, or some other suitable technique. In addition, in another embodiment, no notch 640 may be present in the bottom surface 632 of the housing lid 606, and alignment of the ring structure 608 could be performed in another manner.

In block 810, a lid tuner (e.g., tuner 614) is installed in a complementary tuner hole in the housing lid. This is done, for example, by screwing the lid tuner into the tuner hole.

In block 812, the housing and lid are then assembled, forming a resonant cavity (e.g., cavity 622) within which the resonator is positioned. The housing includes microstrips (e.g., microstrips 612) and an electronic tuner (e.g., tuner 616), in one embodiment.

The resonant frequency of the DRO is then measured, in block 814, and the lid tuner is adjusted to achieve the desired frequency, if necessary. The method then ends.

As with the embodiments described in conjunction with FIGS. 2–5, one advantage to the method described above is that it is not necessary for the DRO circuitry (e.g., microstrips 612 and electronic tuner 616) to be subjected to the high-temperature, heat curing processes that were necessary in prior art systems. In addition, because the ring structure can be accurately positioned using a complementary notch in the housing lid, and the ring structure height can be pre-designed to yield the desired phase noise, the iterative position adjustment process that was necessary using prior art systems is not necessary using the present invention.

Figure 9:
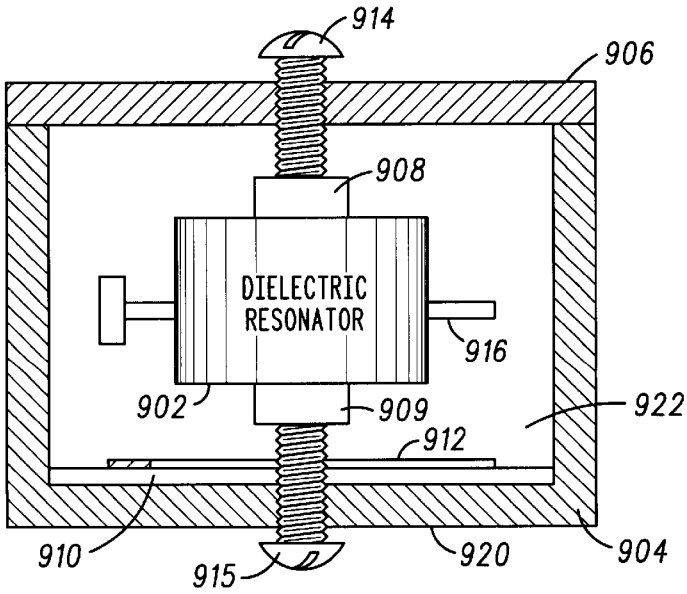
FIG. 9 illustrates a cross-sectional, side view of a DRO in accordance with a third embodiment of the present invention.

FIG. 9 illustrates a cross-sectional, side view of a DRO in accordance with a third embodiment of the present invention. DRO 900 is similar to the DRO 200 described in conjunction with FIG. 2, in that it includes dielectric resonator 902, housing 904, housing lid 906, printed wiring board substrate 910, microstrips 912, and electric tuner 916. Each of these components functions much in the same manner as the embodiments described in conjunction with FIG. 2.

The embodiment shown in FIG. 9 differs from the embodiment shown in FIG. 2, however, in that two tuning screws 914, 915 and two dielectric pedestals 908, 909 are used to hold resonator 902 in a fixed position with respect to housing 904 and housing lid 906. Pedestals 908, 909 are made of a solid, low-loss, low-dielectric constant material, such as alumina, sapphire, Eco-foam, lithium niabate or boron nitride, for example.

Tuning screws 914, 915 are electrically conductive, and they are used to coarsely tune resonator 902 (e.g., within about one percent of the resonant frequency). The first tuning screw 914, referred to as the "lid tuner," is engaged with and extends through lid 906 for selective vertical movement into cavity 922 along the vertical axis of resonator 902. Rather than having an air gap (e.g., air gap 250, FIG. 2) between the tuning screw 914 and resonator 902, a first dielectric pedestal 908, referred to a the "lid pedestal," contacts the end of tuning screw 914 and a center portion of the top surface of resonator 902, providing capacitive spacing between screw 914 and resonator 902.

The second tuning screw 915, referred to as the "housing tuner," is engaged with and extends through the bottom 920 of housing 904, also for selective vertical movement into cavity 922 along the vertical axis of resonator 902. A second dielectric pedestal 909, referred to as the "housing pedestal," contacts the end of tuning screw 915 and a center portion of the bottom surface of resonator 902, also providing capacitive spacing between screw 915 and resonator 902. Once assembled, the tuning screws 914, 915 and pedestals 908, 909 result in a solid assembly, in which the resonator 902 will not sway.

During a tuning process, the resonant frequency of DRO 900 is tested, and the stability of DRO 900 is adjusted by moving tuning screws 914, 915 into and out of cavity 922 until the desired frequency is obtained. As one screw is moved into cavity 922, the other screw is moved out of cavity 922, so that the resonator 902 continues to be supported by both tuning screws 914, 915 and pedestals 908, 909.

Figure 10:
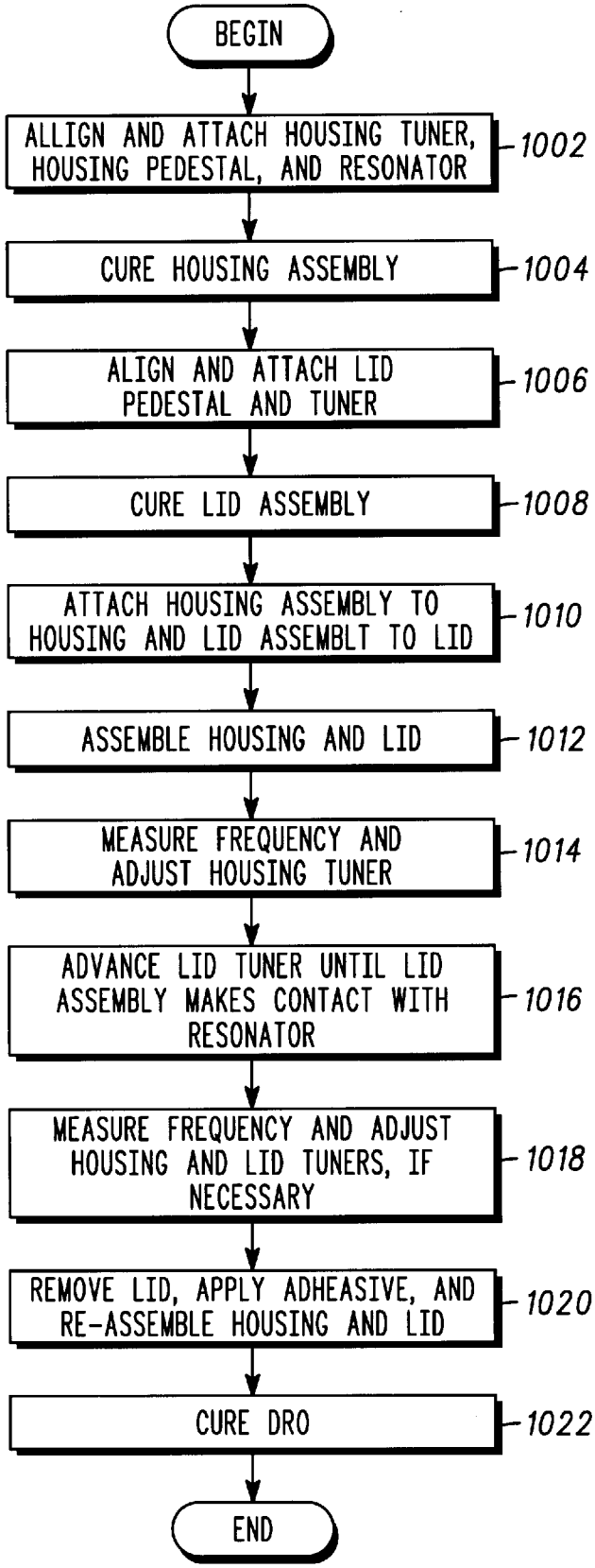
FIG. 10 illustrates a flowchart of a method for assembling the DRO shown in FIG. 9 in accordance with one embodiment of the present invention.

FIG. 10 illustrates a flowchart of a method for assembling the DRO 900 shown in FIG. 9 in accordance with one embodiment of the present invention. The method begins, in block 1002, by aligning and attaching together the housing tuner (e.g., tuner 915, FIG. 9), housing pedestal (e.g., pedestal 909), and resonator (e.g., resonator 902). In one embodiment, this is done by applying an adhesive, such as an epoxy, to the end of the housing tuner, the top and bottom of the housing pedestal, and/or the center portion of the bottom of the resonator. The three components are then aligned and pressed together. In one embodiment, the components are accurately aligned using a sleeve or other alignment mechanism, which is designed to align components of the size and shape of the tuner, pedestal, and resonator.

If necessary, the adhesive is then cured, in block 1004, by heating the housing tuner, housing pedestal, and resonator, referred to as the "housing assembly." In other embodiments, the components could be attached together using some other mechanism, such as an adhesive that requires no curing or some other suitable technique.

In block 1006, the lid pedestal (e.g., pedestal 908) and lid tuner (e.g., tuner 914) are aligned and attached together. In one embodiment, this is done in a manner similar to aligning and attaching the housing tuner and the housing pedestal. If necessary, the adhesive used to attach the lid pedestal and lid tuner is cured, in block 1008, by heating the lid tuner and lid pedestal, referred to as the "lid assembly."

In block 1010, the housing assembly is attached to the housing by installing the housing tuner in a complementary tuner hole in the bottom of the housing. Similarly, the lid assembly is attached to the lid by installing the lid tuner in a complementary tuner hole in the lid. This is done, for example, by screwing the housing tuner and the lid tuner into the tuner holes.

In block 1012, the housing and lid are then assembled, forming a resonant cavity (e.g., cavity 922) within which the resonator is positioned. The housing includes microstrips (e.g., microstrips 912) and an electronic tuner (e.g., tuner 916), in one embodiment.

The resonant frequency of the DRO is then measured, in block 1014, and the housing tuner is adjusted to achieve the desired frequency, if necessary. In one embodiment, the resonator height is initially set to a pre-defined height that is known to have the desired stability characteristics throughout a desired temperature range, and then that height is adjusted, if necessary.

Once the desired frequency is achieved, the lid tuner is advanced into the cavity, in block 1016, until the lid assembly makes contact with the resonator. This may affect the resonant frequency. Accordingly, the resonant frequency is again measured, in block 1018, and the housing and lid tuners are adjusted, if necessary, until the desired resonant frequency is obtained. Adjustment of the housing and lid tuners is done in a complementary manner, so that the resonator remains clamped between the housing and lid pedestals. In other words, as one tuner is backed out of the resonant cavity, the other tuner is advanced into the resonant cavity, so that both pedestals continue to contact the resonator.

Once the desired resonant frequency is attained, the lid is removed, in block 1020, adhesive is applied to the bottom of the lid pedestal and/or the center portion of the top of the resonator. The housing and lid are then re-assembled, and the lid tuner is advanced until the lid pedestal makes contact with the resonator. If necessary, the adhesive used to attach the lid pedestal and resonator is cured, in block 1022, by heating the DRO. After block 1022, the method ends.

In an alternate embodiment, prior to block 1010, the resonator could be attached to the lid assembly, rather than to the housing assembly. Then, the lid tuner could be adjusted, in block 1014, to initially achieve the resonant frequency. Finally, the bottom pedestal and resonator would be attached together, in block 1020.

Where prior art methods require the DRO to be cured twice, only a single curing process is performed in this embodiment. Therefore, one advantage to the present invention is that the DRO circuitry (e.g., microstrips 912 and electronic tuner 916) is subjected to fewer heating processes, thus increasing the yield. As described previously, in other embodiments, the components could be attached together using some other mechanism, such as an adhesive that requires no curing or some other suitable attachment technique. In such embodiments, it would not be necessary to subject the DRO circuitry to any heating process.

Still another advantage to this embodiment is that the resonator can be accurately positioned in the horizontal plane within the resonant cavity, because the tuning screw locations can be set to machine tolerances, and because the resonator, pedestals, and tuning screws can be accurately aligned using a sleeve or other alignment method. Thus, the iterative position adjustment process that was necessary using prior art systems is not necessary using the present invention.

A significant advantage to all of the embodiments described above is that the support structures of the various embodiments hold the resonator in a fixed position with respect to the housing. This results in a DRO that is much less susceptible to performance degradation in the presence of mechanical vibration. This makes the DROs of the various embodiments useful in mobile and other applications for which prior art DROs were not practical.

In the foregoing detailed description, reference is made to the accompanying drawings, which form a part hereof, and in which are shown by way of illustration specific embodiments in which the invention may be practiced. These embodiments are described in sufficient detail to enable those skilled in the art to practice the invention. The foregoing detailed description uses terms that are provided in order to make the detailed description more easily understandable. It is to be understood that these terms and the phraseology employed in the description should not be construed to limit the scope of the invention.

It will be understood by those skilled in the art that the operations of the methods shown and described herein can be carried out in a different order than those described with reference to the drawings. It will be further understood that the various elements illustrated in the drawings are merely representational and are not drawn to scale. Certain proportions thereof may be exaggerated, while others may be minimized. The drawings are intended to illustrate various implementations of the invention, which can be understood and appropriately carried out by those of ordinary skill in the art.

It will be appreciated by those of ordinary skill in the art that any arrangement, which is calculated to achieve the same purpose, may be substituted for the specific embodiment shown. For example, although the description refers to resonators, pedestals, and support structures of various materials and having particular shapes, numerous other materials and component shapes could be used without departing from the spirit and scope of the present invention.

This application is intended to cover any adaptations or variations of the present invention that fall within its scope. The foregoing detailed description, therefore, is not to be taken in a limiting sense, and it will be readily understood by those skilled in the art that various changes in the details, materials, and arrangements of the parts and operations which have been described and illustrated in order to explain the nature of this invention may be made without departing from the spirit and scope of the invention as expressed in the adjoining claims.

What is claimed is:

1. A dielectric resonator oscillator (DRO) comprising:

a housing;

a housing lid having a bottom surface that completes a resonant cavity when the housing lid is attached to the housing;

a dielectric resonator positioned within the resonant cavity; and a support structure comprising a conductive material and extending downward from the bottom surface of the housing lid, which contacts a top surface of the dielectric resonator, holding the dielectric resonator in a fixed position with respect to the housing lid, wherein the support structure comprises one or more support legs, and wherein each of the one or more support legs includes a step with a first surface and a second surface, and the first surface is substantially parallel to and contacts the top surface of the dielectric resonator and the second surface is substantially parallel to and contacts a side surface of the dielectric resonator.

2. The DRO as claimed in claim 1, wherein the support structure comprises a ring structure having a bottom surface that contacts the top surface of the dielectric resonator.

3. The DRO as claimed in claim 2, wherein an outer circumference of the ring structure is approximately equal to a circumference of the dielectric resonator.

4. The DRO as claimed in claim 2, wherein the ring structure is coupled to the housing lid, and the housing lid comprises a notch on the bottom surface of the housing lid within which the ring structure is seated when it is coupled to the housing lid.

5. The DRO as claimed in claim 1, wherein the one or more support legs are integrally attached to the housing lid.

6. The DRO as claimed in claim 1, wherein the one or more support legs are coupled to the housing lid.

7. The DRO as claimed in claim 6, wherein the housing lid comprises a notch on the bottom surface within which the one or more support legs are seated when they are coupled to the housing lid.

8. The DRO as claimed in claim 1, wherein the one or more support legs include at least three support legs that provide at least three points of support to the dielectric resonator.

9. A dielectric resonator oscillator (DRO) comprising:

a housing;

a housing lid having a bottom surface that completes a resonant cavity when the housing lid is attached to the housing;

a dielectric resonator positioned within the resonant cavity; and one or more support legs comprised of a conductive material and integrally attached to and extending downward from the bottom surface of the housing lid, which contact a top surface of the dielectric resonator, holding the dielectric resonator in a fixed position with respect to the housing lid, wherein each of the one or more support legs includes a step with a first surface and a second surface, and the first surface is substantially parallel to and contacts the top surface of the dielectric resonator and the second surface is substantially parallel to and contacts a side surface of the dielectric resonator.

10. The DRO as claimed in claim 9, wherein the one or more support legs include at least three support legs that provide at least three points of support to the dielectric resonator.

11. A method of assembling a dielectric resonator oscillator (DRO) that includes a housing and a housing lid having a bottom surface that completes a resonant cavity when the housing lid is attached to the housing, the method comprising:

attaching a top surface of a dielectric resonator to a first support structure comprised of a conductive material that extends downward from the bottom surface of the housing lid, so that the dielectric resonator is held in a fixed position with respect to the housing lid;

assembling the housing and the housing lid; and adjusting one or more tuners until the DRO has a desired frequency.

12. The method as claimed in claim 11, wherein the first support structure comprises one or more support legs, and attaching the top surface of the dielectric resonator to the first support structure comprises attaching the top surface of the dielectric resonator to the one or more support legs, each of the one or more support legs including a step with a first surface and a second surface, and the first surface is substantially parallel to and contacts the top surface of the dielectric resonator and the second surface is substantially parallel to and contacts a side surface of the dielectric resonator.

13. The method as claimed in claim 11, wherein the first support structure comprises a ring structure having a bottom surface, and attaching the top surface of the dielectric resonator to the first support structure comprises attaching the top surface of the dielectric resonator to the bottom surface of the ring structure.

* * * * *